US007448247B2

(12) United States Patent
Knaup

(10) Patent No.: US 7,448,247 B2
(45) Date of Patent: Nov. 11, 2008

(54) DEEP DRAWING METHOD AND DEEP DRAWING MACHINE FOR CARRYING OUT THE METHOD

(75) Inventor: Hans-Jürgen Knaup, Bad-Lippspringe (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 11/531,005

(22) Filed: Sep. 12, 2006

(65) Prior Publication Data

US 2007/0068214 A1 Mar. 29, 2007

(30) Foreign Application Priority Data

Sep. 23, 2005 (DE) ..... 10 2005 045 727

(51) Int. Cl.
*B21D 22/26* (2006.01)

(52) U.S. Cl. ..... 72/350; 72/453.02; 72/453.14; 72/406; 72/450; 72/347

(58) Field of Classification Search ..... 72/343, 72/347, 348, 349, 380, 386, 263, 350, 351, 72/450, 406, 441, 446, 453.01, 453.02, 453.14, 72/431, 432

See application file for complete search history.

(56) References Cited

U.S. PATENT DOCUMENTS 4,205,546 A * 6/1980 Lagasse et al. ..... 72/347

FOREIGN PATENT DOCUMENTS

| | | |
|---|---|---|
| DE | 26 54 199 C2 | 6/1978 |
| DE | 28 25 040 A1 | 12/1978 |
| DE | 39 08 977 A1 | 9/1990 |
| DE | 199 21 176 A1 | 11/2000 |
| DE | 100 62 495 C | 7/2002 |

* cited by examiner

*Primary Examiner*—Derris H. Banks
*Assistant Examiner*—Debra M Wolfe
(74) *Attorney, Agent, or Firm*—Henry M. Feiereisen; Ursula B. Day

(57) ABSTRACT

In a deep drawing method, a sheet metal blank is positioned between two dies of a deep drawing machine and then shaped into a hollow article, whereby the dies, at least during a partial stroke phase, undergo a controlled non-rectilinear relative movement and one of the dies is shifted by a transverse displacement mechanism in a direction transversely to a stroke direction.

9 Claims, 6 Drawing Sheets

DEEP DRAWING METHOD AND DEEP DRAWING MACHINE FOR CARRYING OUT THE METHOD

CROSS-REFERENCES TO RELATED APPLICATIONS

This application claims the priority of German Patent Application, Ser. No. 10 2005 045 727.4-14, filed Sep. 23, 2005, pursuant to 35 U.S.C. 119(a)-(d), the content of which is incorporated herein by reference.

BACKGROUND OF THE INVENTION

The present invention relates, in general, to a deep drawing method, and to a deep drawing machine for carrying out the method.

Nothing in the following discussion of the state of the art is to be construed as an admission of prior art.

In general, deep drawing machines involve a type of shaping tool having tools which move generally rectilinear and respectively include dies between which a sheet metal blank can be formed into a suitable cup-shape to assume the desired shape. Examples include crank presses, eccentric presses, hammers, and hydraulic presses. Shaping of metals, in particular sheet metals, typically involves the use of presses in which the die and the plunger moving the die undergo a rectilinear closing motion. Also the opening motion is executed along a straight line.

German Offenlegungsschrift DE 199 21 176 A1 describes a press for making irregularly curved sheets. The press includes an upper die and a lower die which are both configured with a plurality of height-adjustable cables arranged in rows in length direction and transverse direction and which are controllable independently from one another. This press is complicated in structure, and the design of the cable contact surfaces in the contact area to the sheet metal being shaped is difficult to realize in order to attain a desired surface quality of the metal blank.

It would therefore be desirable and advantageous to provide an improved deep drawing method and improved deep drawing machine to obviate prior art shortcomings and to allow manufacture of irregular sheets in a single operating cycle.

SUMMARY OF THE INVENTION

According to one aspect of the present invention, a deep drawing method includes the steps of positioning a sheet metal blank between two dies of a deep drawing machine, and shaping the sheet metal blank into a hollow article by having the dies, at least during part of a stroke phase, undergo a controlled non-rectilinear relative movement, and shifting one of the dies by a transverse displacement mechanism in a direction transversely to a stroke direction.

The present invention resolves prior art problems by moving the dies, at least during part of the stroke phase, in a controlled manner along a non-rectilinear course in relation to one another. As a result, the surface normals upon the dies extend at an angle to one another during the part of the stroke phase. While conventional presses encounter an unwanted off-center load which leads to a tilting between table and plunger as well as to a shift of the center of table and plunger in perpendicular relationship to the operating direction and thus to an offset, the present invention exploits the intended tilt of the dies in order to shape the metal blanks which, based on the geometry, cannot be molded rectilinearly and/or demolded. In accordance with the present invention, the plunger is able to travel different paths to accommodate die regions of different depths.

During closing motion, the surface normals of the dies do not extend perpendicular to one another, at least temporarily, but extend at an angle that allows in certain applications the production of hollow articles which would not be possible with a rectilinear closing motion or only possible when using complex dies. The deep drawing method according to the invention is especially beneficial for making hot-formed hollow articles in a single operating stroke. Slides and other components which act transversely to the stroke direction of the dies are prone to fail in particular when hot-forming processes are involved. Thus, the deep drawing method according to the invention enables a significant reduction in die costs, in particular when hot-forming is involved. Of course, slides and other components that are shiftable in a direction transversely to the stroke direction of the dies may also be used within the scope of the invention so long as the geometry of the hollow article dictates this. Simple undercuts can also be made in a quick and cost-efficient manner.

According to another feature of the invention, the surface normals of the dies define an angle which during shaping can be relatively small and may range from about 5° to 30°. Even at this fairly small angle range, the deep drawing process according to the invention is applicable for a much wider field than conventional deep drawing processes.

According to another feature of the invention, the non-rectilinear relative movement between the dies may be effectuated along a curve with constant pitch direction. Suitable is, for example, a circular arc course because it allows easy shaping of the sheet metal blank and easy separation of the dies, once the shaping process has been carried out. Of course, curves deviating from a circular arc are also covered within the scope of the present invention, so long as the pitch of the curve slightly increases as the closing motion progresses.

The non-rectilinear relative movement between the dies is not critical during an initial phase of the metal shaping process as far as resultant forces is concerned because the maximum shaping force has not yet been applied during this phase. Once the dies are fully pressed against one another, the shaping force increases however to a maximum level. In the final stage, the dies are, of course, in alignment, resulting in a substantial coincidence of the surface normals so that the offset approaches zero. In view of this process sequence, stands of conventional deep drawing machines can be used with a deep drawing process according to the invention in view of their capability to absorb transverse forces acting on the side of the dies.

The non-rectilinear relative movement can be realized in two ways. One way is to mount the dies in die holders which execute the non-rectilinear relative movement, with at least one of the dies being swingable in relation to its associated die holder. Another way involves a construction in which the die holders with attached dies execute themselves a non-rectilinear relative movement. Control and mechanics of the deep drawing machine can be simplified when only one die or die holder is shiftable relative to the other die during the critical non-rectilinear stroke phase, in particular in relation to the sideways movement.

Of course, a combination of a relative movement of one die in relation to its die holder and a simultaneous non-rectilinear relative movement of this die holder in relation to the other die holder is possible as well.

The non-rectilinear relative movement generates during the deep drawing process necessarily transverse forces which have to be absorbed by respective abutments. Therefore, according to another feature of the present invention, it is proposed that one die holder is fixed and swingably connected to the other die holder, which is movable and shiftable by a plunger which moves in a straight line in relation to the fixed die holder, when moving in a direction of the movable die holder. The pivoting linkage between the die holders results in a direct absorption of transverse forces by the die holders so that the stand for the deep drawing machine is not subjected to added stress. Suitably, the movable die holder is configured to enable the plunger to apply a force in midsection. The movable die holder has a plunger-confronting contact surface which slides in relation to the plunger or rolls on the plunger. The contact surface may involve an outer cylinder surface or a spherical surface.

According to another aspect of the present invention, a deep drawing machine for shaping a sheet metal blank into a hollow article includes an upper die holder carrying a die, a lower die holder carrying a die, and an operating mechanism for moving the die holders relative to one another in a controlled, non-rectilinear manner at least during part of a stroke phase, wherein the operating mechanism includes a plunger assembly operatively connected to and moving the die of the upper die holder in a direction of the die of the lower die holder, and a transverse displacement mechanism for providing lateral support of the upper die holder. Suitably, the non-rectilinear movement is effectuated along a curve with constant pitch direction, in particular along an arc of a circular.

According to another feature of the present invention, the die holders may execute a rectilinear movement, with at least one of the dies being swingably supported in relation to its die holder to realize the non-rectilinear relative movement. Normally, the die, die holder and plunger are firmly connected together and are moved in a straight line in relation to a table on which the other die holder with attached die is mounted. By allowing a movement of the dies in relation to the die holder, a conventional press with rectilinear relative movement can be retrofitted. The non-rectilinear movement can be realized in particular by the lateral offset during the critical stroke phase. Of course, it is also conceivable to provide the deep drawing machine with at least one die holder which executes a non-rectilinear relative movement.

It is also conceivable to configure the plunger assembly to execute a non-rectilinear relative movement of an upper die. The plunger assembly may hereby be swingably supported in relation to a stand or frame and includes the transverse displacement mechanism. The plunger assembly may be constructed for adaptive control or continuous-path control. A deep drawing machine with continuous-path control, such as toggle presses, crank presses or eccentric presses, although more complex in structure than an adaptive-control, hydraulic deep drawing machine, is easier to control than a deep drawing machine with adaptive-control. A reason for the easier control can partly be ascribed to the system-based response times of hydraulic components because a non-rectilinear relative movement requires a precise coordination in particular of the transverse displacement mechanism with the vertically acting stroke cylinders which are actuated asynchronously. Still, both deep drawing machines with continuous-path control or adaptive control are suitable to realize a non-rectilinear relative movement of the dies at least during part of the stroke phase of the deep drawing process.

According to another feature of the present invention, a blank holder may be provided which undergoes a non-rectilinear relative movement in relation to one of the dies.

A deep drawing method and deep drawing machine in accordance with the present invention, allows implementation of a non-rectilinear relative movement in the form of a curve in two planes as well as a spatial curve. When a spatial curve is involved, one die is required to move three-dimensionally in the space so that the use of a plunger assembly is needed having at least three plungers in order to allow a swinging of the one die in three dimensions. The kinematics for three or more hydraulic cylinders to guide the die becomes thus more complex than in case of an assembly with two hydraulic cylinders and a single pivot axis. Control for complex spatial motions of the die can be best addressed by using hydraulic deep drawing machines.

In theory, it is possible to utilize the control system of a hexapod machine so that the plunger would have six degrees of freedom. However, the use of a hexapod machine requires an angular disposition of the spindle and piston drives so that the portion of normal forces acting upon the plunger is significantly decreased. This in turn reduces the efficiency of a deep drawing machine with adaptive control. It is best to have the stroke cylinders execute substantially parallel stroke movements.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
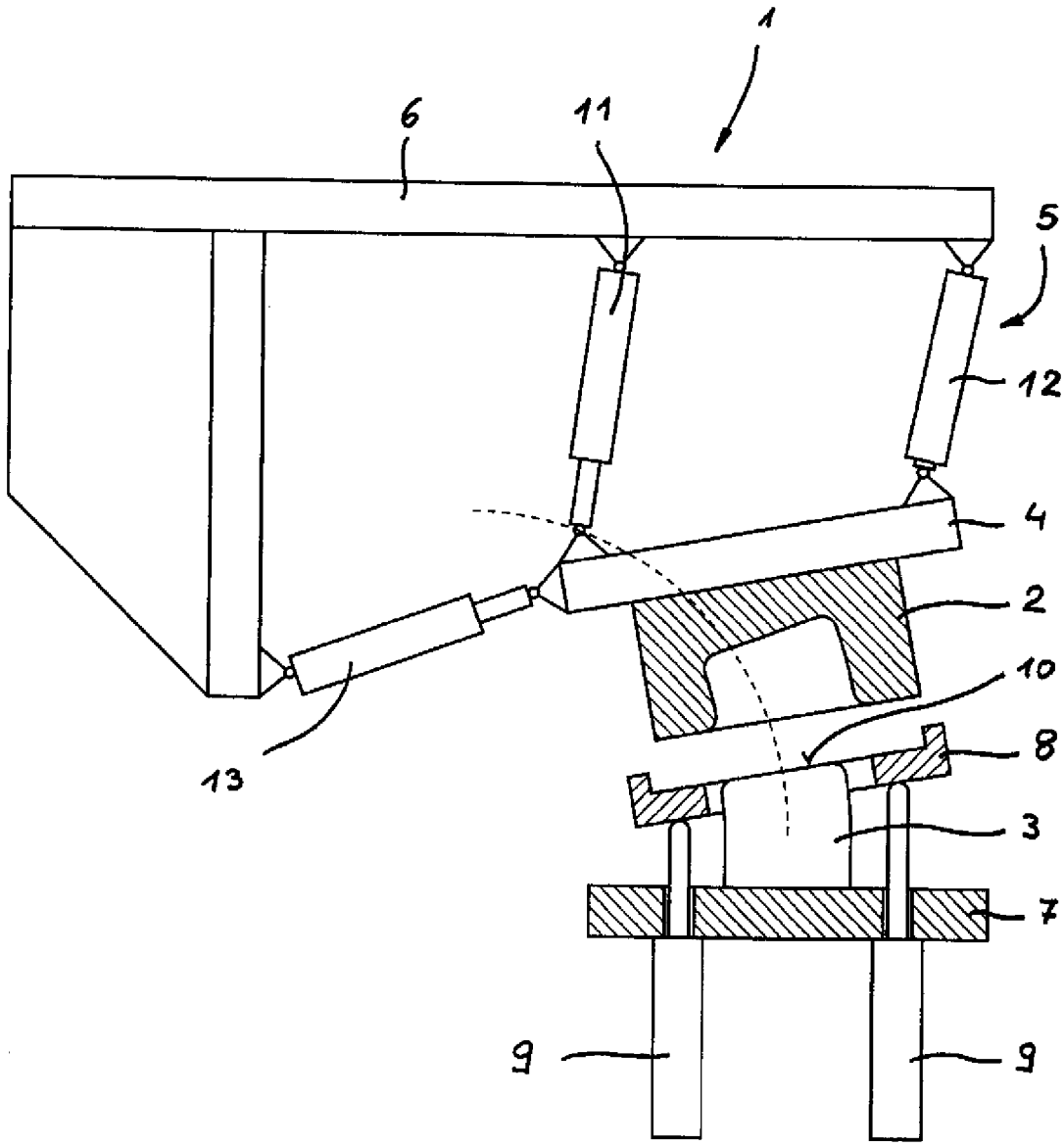
FIG. 1 is a schematic and simplified partly sectional illustration of one embodiment of a deep drawing machine according to the present invention in a first phase of a deep drawing method according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic and simplified partly sectional illustration of one embodiment of a deep drawing machine according to the present invention, generally designated by reference numeral 1, for carrying out a deep drawing method according to the present invention. The deep drawing machine 1 is configured with adaptive control and includes an upper tool with a die 2 and a lower tool with a die 3, wherein the dies 2, 3 have complementary contour and cooperate with one another to shape an unillustrated sheet metal blank disposed between the upper and lower dies 2, 3.

The upper die 2 is mounted to a die holder 4 which is connected to a frame 6 through intervention of a plunger assembly, generally designated by reference numeral 5. The plunger assembly 5 is provided to move the upper die 2 in a direction of the lower die 3 which is secured to a lower die holder 7. Disposed between the upper and lower dies 2, 3 is a blank holder 8 for applying the necessary counterforce via jacks 9 so as to properly hold the sheet metal blank in place during the deep drawing process. FIG. 1 shows the initial phase of the deep drawing process in which the blank holder 8 is in alignment with an end surface of the lower die 3.

As indicated by the broken line, the dies 2, 3 are guided along a non-rectilinear relative movement. While the lower die 3 does not change its disposition in horizontal direction, the upper die 2 follows a curved course indicated by the broken line. The dies 2, 3 are hereby so configured that an engagement is impossible if the dies were moved along a rectilinear pathway. The contour of the dies 2, 3, is shown here by way of example only to illustrate the prerequisite to necessitate a non-rectilinear relative movement between the dies 2, 3 during the deep drawing process. The shaping operation is hereby implemented by a control unit, which is not shown in greater detail and causes the upper die 2 to move along a pathway in a direction of the lower die 3, as will now be described with reference to FIGS. 2 to 4.

Figure 2:
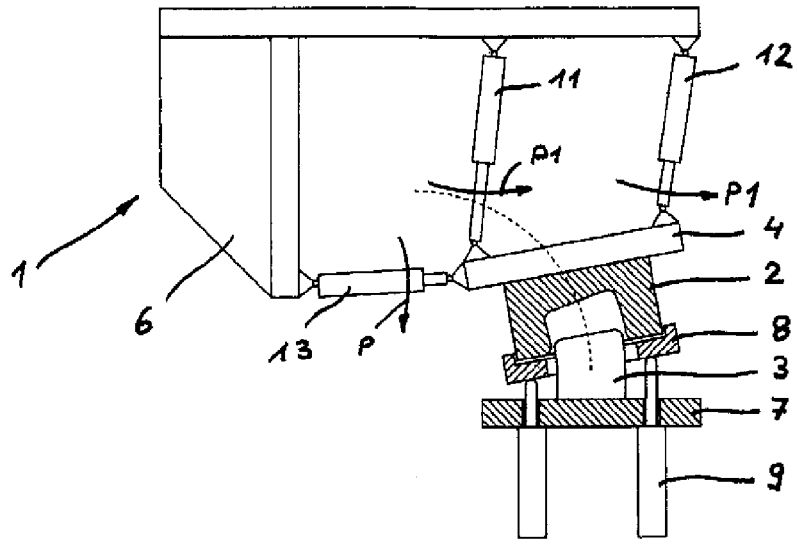
FIGS. 2 to 4 are partly sectional illustrations of the deep drawing machine undergoing subsequent operating phases.
Figure 3:
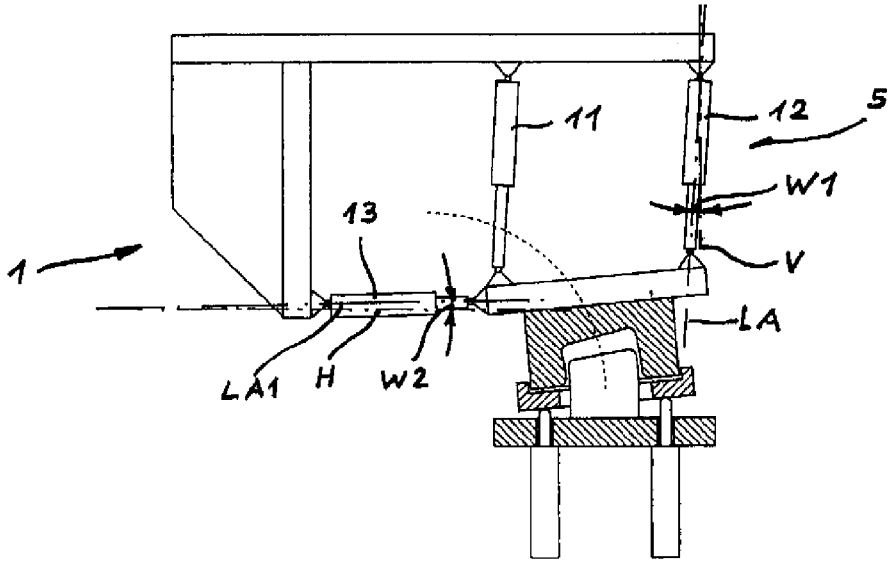

The non-rectilinear relative movement between the dies 2, 3 is realized by the plunger assembly 5, which, by way of example, includes two stroke cylinders 11, 12 for effecting a vertical shift of the upper die holder 4 and its die 2. The stroke cylinders 11, 12 extend parallel to one another and have opposite ends which are swingably supported to the frame 6 and the die holder 4, respectively. In addition, the deep drawing machine I includes a transverse displacement mechanism 13, which, by way of example, is implemented by a stroke cylinder as well. As shown in FIG. 2, once the sheet metal blank is positioned in place, the stroke cylinders 11,12 move out to force the upper die 2 in the direction of the lower die 3 in opposition to the force applied by the jacks 9. The end surface of the upper die 2 bears against the blank holder 8, with the sheet metal blank being sandwiched therebetween (FIG. 3). The blank holder 8 and the upper die 2 are hereby moved along the curved pathway, as indicated by the broken line. The die 2 is laterally guided by the transverse displacement mechanism 13 which is moved in a direction of arrow P during the deep drawing process. At the same time, the stroke cylinders 11, 12, which move asynchronously, are swung in a direction of arrow P1. As the stroke cylinders 11, 12 swing and the upper die 2 moves along the curved path, an angle WI between the vertical V and the length axis LA of the stroke cylinders II, 12 becomes progressively smaller, as a comparison between FIGS. 1, 2 and 3 demonstrates. In addition, an angle W2 between the length axis LA1 of the transverse displacement mechanism 13 and the horizontal H also decreases.

Figure 4:
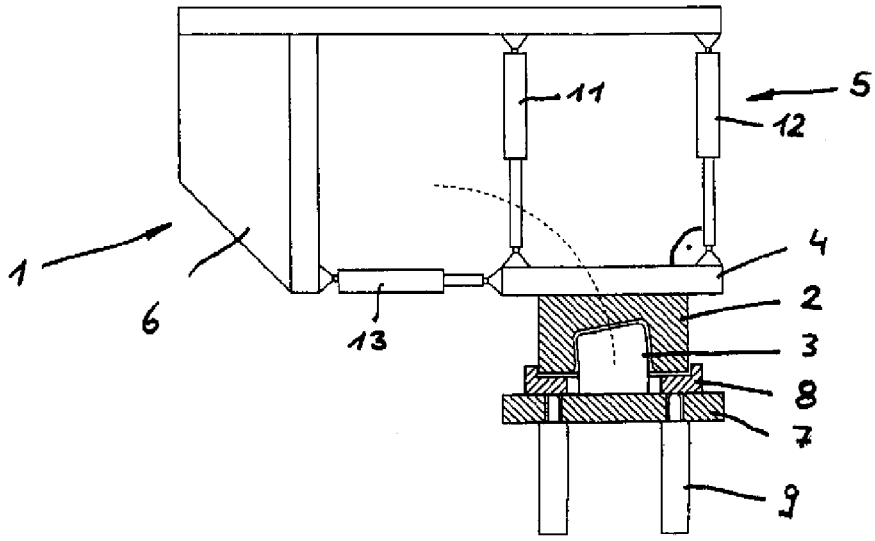

In the closed position, as shown in FIG. 4, a maximum shaping force is applied, whereby the stroke cylinders 11, 12 extend vertically and the transverse displacement mechanism 13 extends horizontally. In this stage of the deep drawing process, the jacks 9 are fully retracted and the blank holder 8 rests upon the lower die holder 7.

Following the conclusion of the deep drawing process, the dies 2, 3 are separated again from one another by controlling the operation of the stroke cylinders 11, 12 and the transverse displacement mechanism 13 accordingly so as to move the dies 2, 3 relative to one another along the curved path, as indicated by the broken line. The jacks 9 move out again to position the blank holder 8 in the illustrated elevated, slanted disposition so that the deep drawing machine 1 can begin a new cycle.

Figure 5:
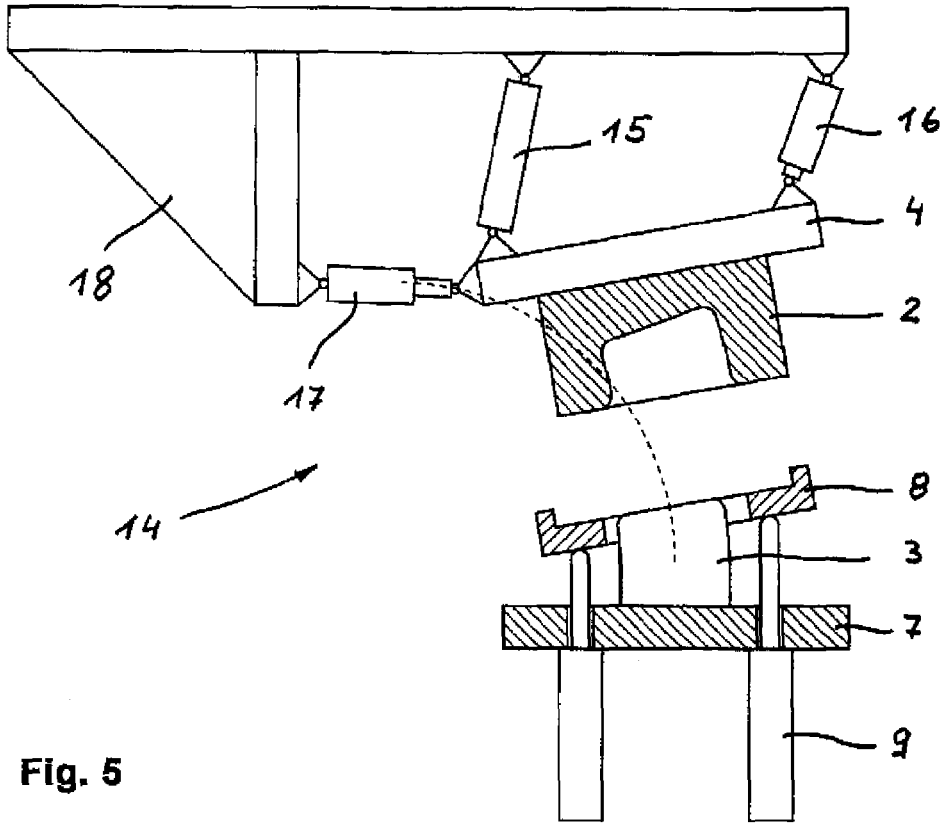
FIG. 5 is a schematic and simplified partly sectional illustration of another embodiment of a deep drawing machine according to the present invention in a first phase of a deep drawing method according to the present invention.

Referring now to FIG. 5, there is shown a schematic and simplified partly sectional illustration of another embodiment of a deep drawing machine according to the present invention, generally designated by reference numeral 14. Parts corresponding with those in FIG. 1 are denoted by identical reference numerals and not explained again. The description below will center on the differences between the embodiments. In this embodiment, provision is made for a coupling rod 15 of fixed length, instead of a stroke cylinder 11. The coupling rod 15 is swingably mounted to a frame 18 and the upper die holder 4 and extends in parallel relationship to a stroke cylinder 16. Also provided is a transverse displacement mechanism 17 in the form of a stroke cylinder. The coupling rod 15, the stroke cylinder 16 and the transverse displacement mechanism 17 are all articulated to the frame 18.

As the coupling rod 15 cannot change its length, the kinematics of the deep drawing machine 14 differs from the deep drawing machine 1. Still, the deep drawing machine 14 allows a controlled non-rectilinear relative movement between the upper and lower dies 2, 3, as is also indicated by the broken line. In contrast to the deep drawing machine 1 of FIG. 1, the coupling rod 15 and the stroke cylinder 16 are merely provided here for guiding the upper die holder 4 in concert with the transverse displacement mechanism 17 but are not involved in the application of the entire stroke required for the deep drawing process. The actual stroke can be implemented essentially in two ways. One approach involves the movement of the lower die holder 7 together with the jacks 9 in the direction of the upper die holder 2. Another approach involves a securement of the frame 18 to an unillustrated ram, which is part of a conventional press and moves linearly, so that the ram acts upon by the frame 18 to implement the stroke motion. Of course, a combination of these two approaches is conceivable as well.

An advantage of the deep drawing machine 14 is the presence of more free space between the dies 2, 3 depending on the stroke of the press.

Figure 6:
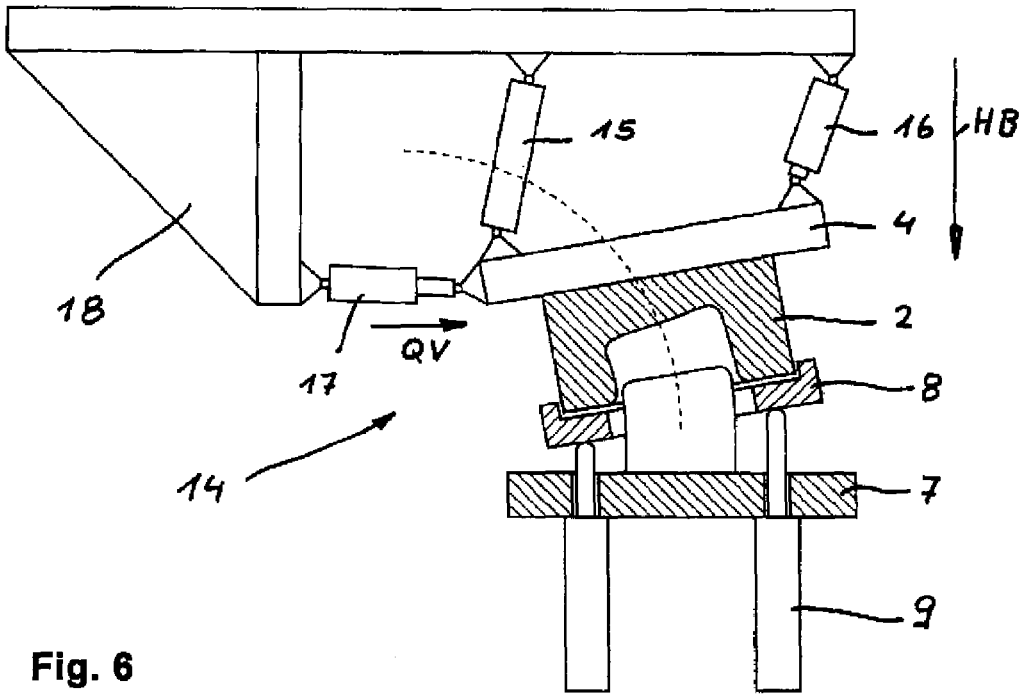
FIGS. 6 to 8 are partly sectional illustrations of the deep drawing machine of FIG. 5 undergoing subsequent operating phases.
Figure 7:
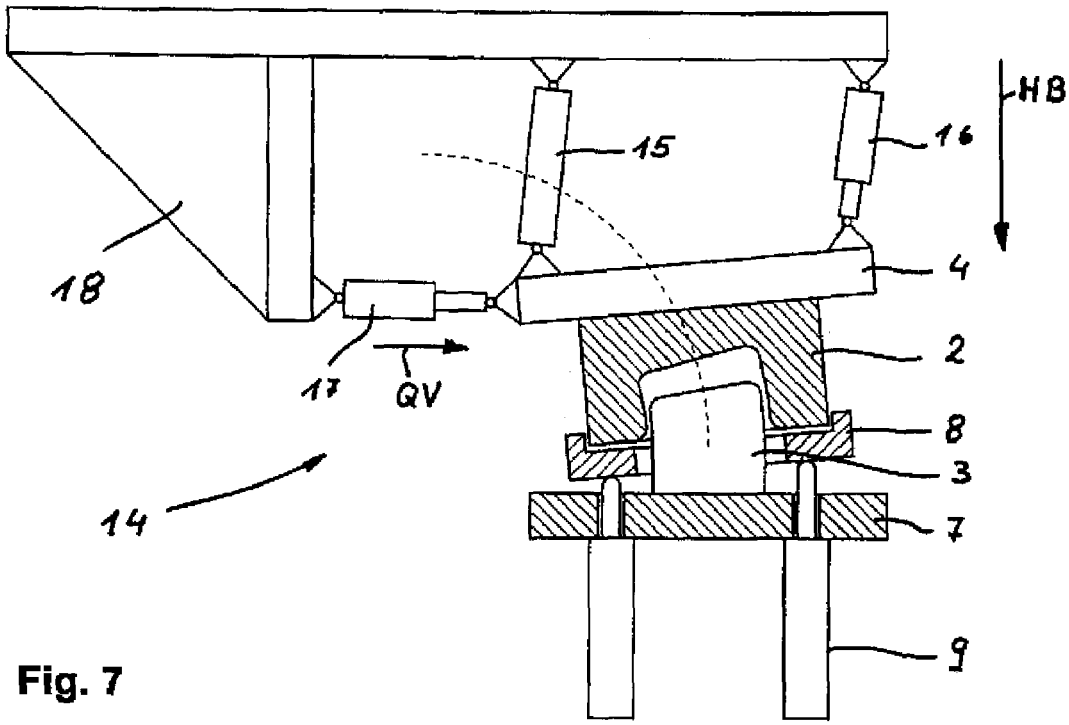

The shaping process of the deep drawing machine 14 will now be described also with reference to FIGS. 6 to 8. Although the tool geometry is the same between the deep drawing machines 1 and 14, the dies 2, 3 of the deep drawing machine 14 are moved initially in a linear manner toward one another. Non-rectilinear relative movement of the dies 2, 3 is executed only during the actual shaping operation, i.e. during part of a stroke path, whereby the stroke motion HB is superimposed with the transverse displacement QV of the dies 2, 3 by means of the transverse displacement mechanism 17.

It should be noted that although the provision of stroke cylinders is illustrated in the drawing, such illustration is for expediency only and should not be regarded as a limitation since the use of stroke cylinders is far from essential to this invention. For example, it is, of course, also conceivable, to arrange suitable transmission elements, such as, e.g., toggle mechanisms or cam drives. Also conceivable within the scope of the present invention is a combination of piston and cylinder systems with mechanical lever systems and cam drives.

Figure 8:
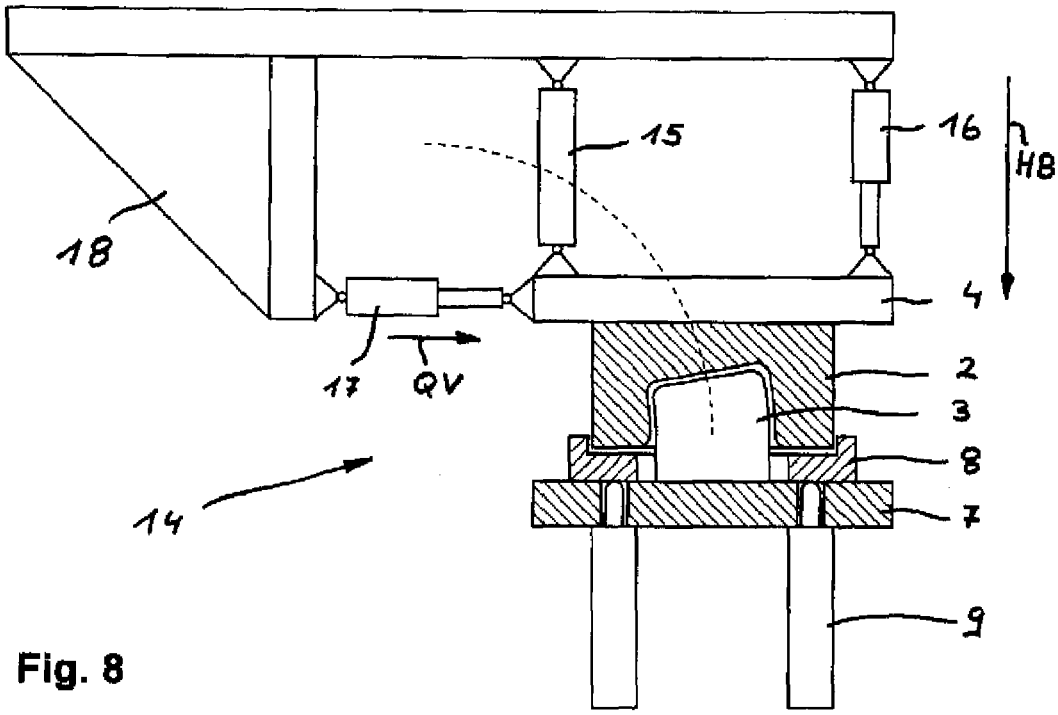

In the closed position, as shown in FIG. 8, a maximum shaping force is applied, whereby the coupling rod 15 and the stroke cylinder 16 extend vertically in the drawing plane and the transverse displacement mechanism 17 extends horizontally, so that the influence of transverse forces onto the press frame is minimal and forces act almost entirely in stroke direction. The jacks 9 are again fully retracted and the blank holder 8 rests upon the lower die holder 7.

Figure 9:
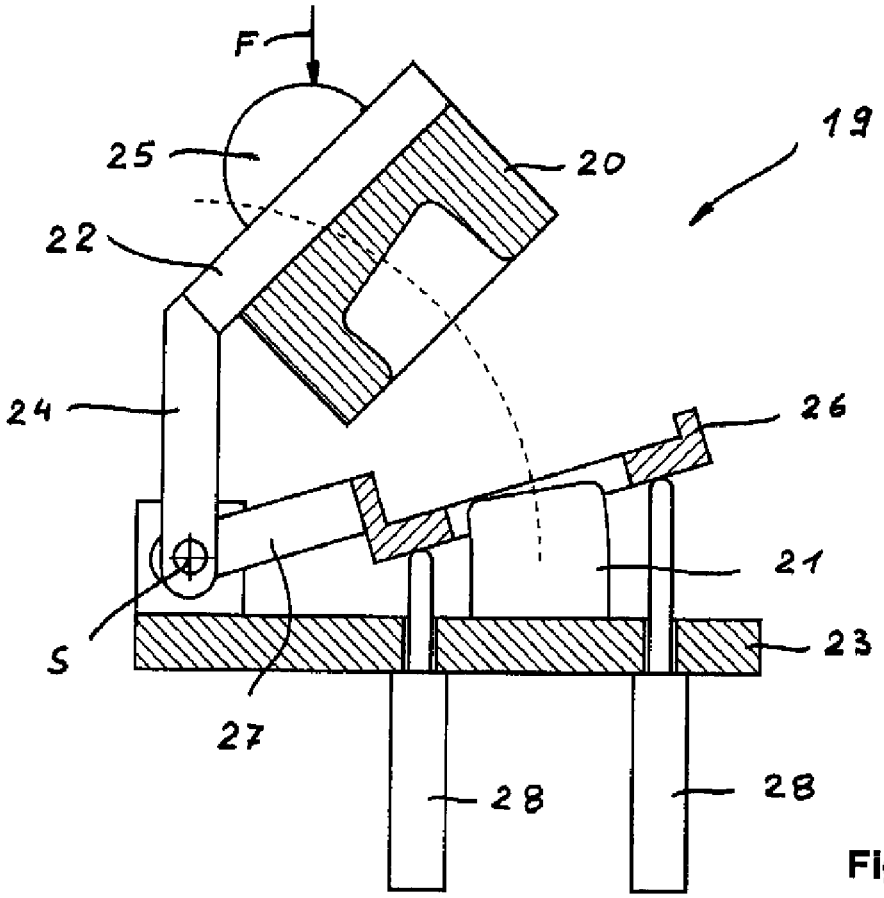
FIG. 9 is a schematic and simplified partly sectional illustration of yet another embodiment of a deep drawing machine according to the present invention in a first phase of a deep drawing method according to the present invention.
Figure 10:
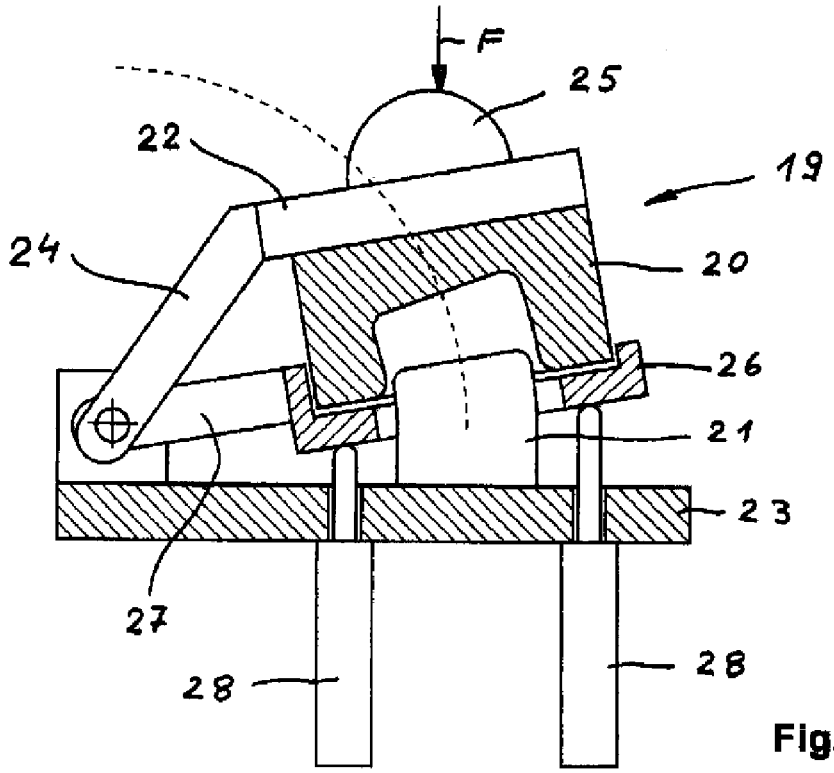
FIGS. 10 to 12 are partly sectional illustrations of the deep drawing machine of FIG. 9 undergoing subsequent operating phases.

Referring not to FIG. 9, there is shown a schematic and simplified partly sectional illustration of another embodiment of a deep drawing machine according to the present invention, generally designated by reference numeral 19. The description below will center on the differences between the embodiments. In this embodiment, provision is made for an unillustrated ram of a press, with the ram moving linearly to apply a force, as indicated by arrow F, upon a semi-spherical support body 25 to thereby move an upper die 29 towards a lower die 21. The dies 20, 21 are secured to die holders 22, 23, with the upper die holder 22 being connected by a pivot arm 24 to the lower die holder 23 for rotation about a pivot axis S in relation to the die holder 23. Swinging about the pivot axis S causes the upper die 20 to move along a circular arc, as indicated by the broken line. A comparison between FIGS. 9 and 10 shows that the force attack point, i.e. arrow F, migrates to the right in the drawing plane. The support body 25 slides hereby upon the unillustrated ram.

Figure 11:
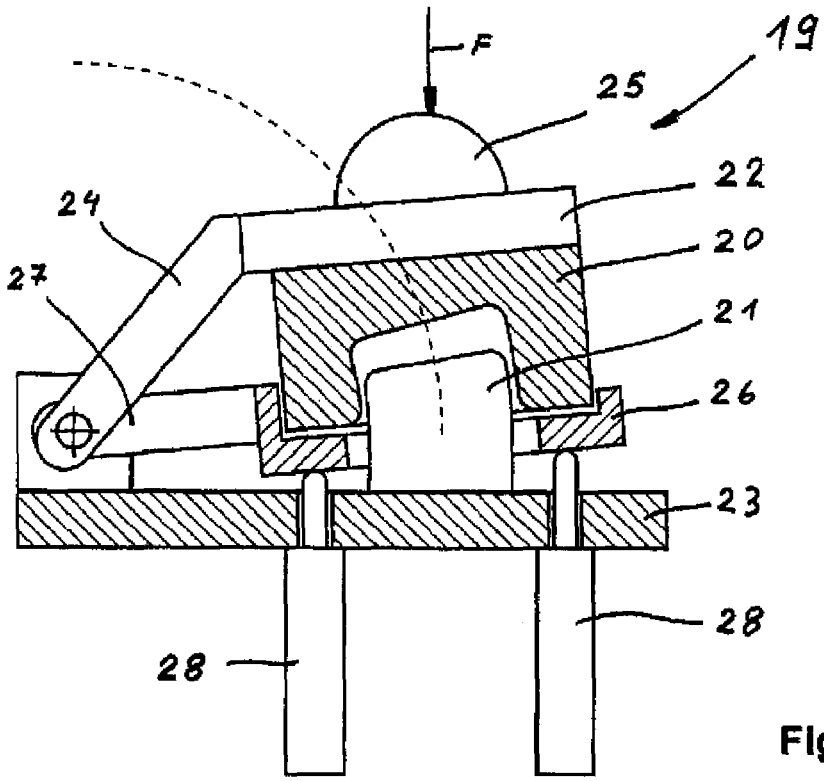
Figure 12:
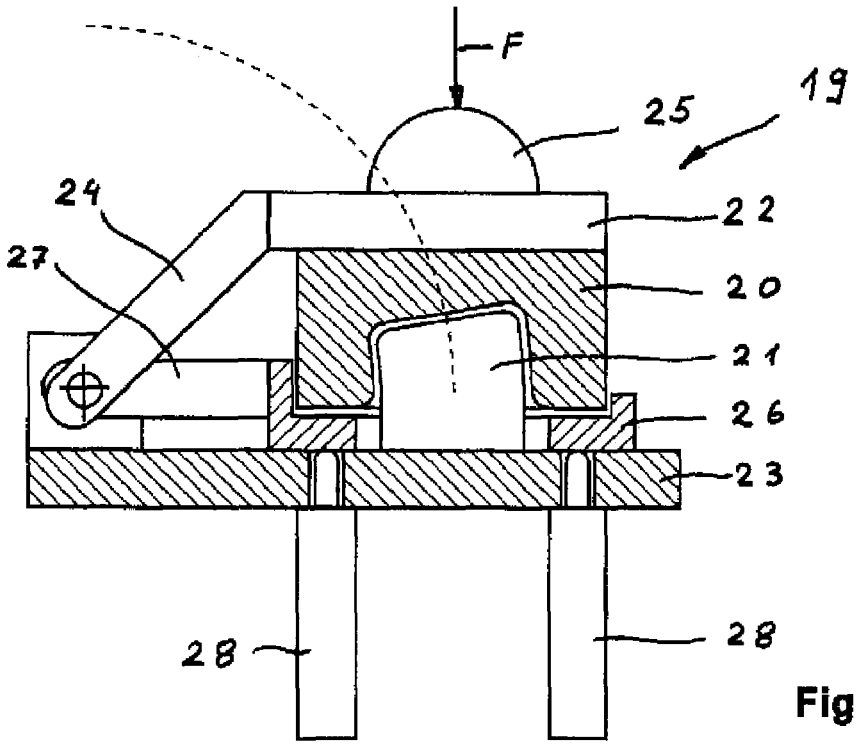

The deep drawing machine 19 is also provided with blank holder 26 which is movably supported by a pivot arm 27 to the lower die holder 23 for rotation about the pivot axis S. The pivot arms 24, 27 of the upper die holder 22 and the blank holder 26 thus rotate about a common pivot axis S. The blank holder 26 is supported by jacks 28 which, due to the pivot motion to be executed, move out differently far. As the shaping operation proceeds during the deep drawing process, the blank holder 26 with the unillustrated sheet metal blank is pushed downwards by the upper die 20, once the upper die 20 abuts against the blank holder 26, as shown in FIG. 11, until the end position is reached, as shown in FIG. 12. In the end position, the force vector F acts in midsection upon the dies 20, 21 so that the required shaping force can be introduced fully into the shaping operation. Lateral forces in the shaping tool or die holders are absorbed so that the need for a transverse displacement mechanism can be eliminated. As a result, the control mechanism for the deep drawing machine 19 can be designed simpler.

In the closed position, as shown in FIG. 12, a maximum shaping force is applied, whereby the pivot arm 27 extends horizontally and the pivot arm 24 extends at an angle of about 45° in relation to the pivot arm 27.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A deep drawing machine for shaping a sheet metal blank into a hollow article, comprising:

an upper die holder carrying a die;

a lower die holder carrying a die;

an operating mechanism for implementing a controlled, non-rectilinear movement between the die holders at least during part of a stroke phase, said operating mechanism including a plunger assembly operatively connected to and moving the die of the upper die holder in a stroke direction of the die of the lower die holder, and a transverse displacement mechanism for providing lateral support of the upper die holder, said transverse displacement mechanism being length-adjustable to move the upper die holder in a direction transversely to the stroke direction; and a blank holder which executes a non-rectilinear relative movement in relation to one of the dies.

2. The deep drawing machine of claim 1, wherein the non-rectilinear movement is effectuated along a curve with constant pitch direction.

3. The deep drawing machine of claim 1, wherein the non-rectilinear movement is effectuated along an arc of a circular.

4. The deep drawing machine of claim 1, wherein at least one of the dies is swingably supported in relation to its die holder.

5. The deep drawing machine of claim 1, wherein at least one of the upper and lower die holders is constructed to execute a non-rectilinear relative movement.

6. The deep drawing machine of claim 1, wherein the plunger assembly is constructed for adaptive control.

7. The deep drawing machine of claim 6, wherein the plunger assembly includes two stroke cylinders which operate in parallel direction and are actuated asynchronously, at least along part of a stroke phase, in coordination with an operation of the transverse displacement mechanism.

8. The deep drawing machine of claim 1, wherein the plunger assembly is constructed for continuous-path control.

9. The deep drawing machine of claim 1, wherein the transverse displacement mechanism is a stroke cylinder.

* * * * *

UNITED STATES PATENT AND TRADEMARK OFFICE

CERTIFICATE OF CORRECTION

PATENT NO. : 7,448,247 B2
APPLICATION NO. : 11/531005
DATED : November 11, 2008
INVENTOR(S) : Hans-Jürgen Knaup It is certified that error appears in the above-identified patent and that said Letters Patent is hereby corrected as shown below:

Column 7, line 7, change “not” to --now--

Signed and Sealed this

Twenty-seventh Day of January, 2009

JOHN DOLL
*Acting Director of the United States Patent and Trademark Office*